United States Patent [19]

Wilson et al.

[11] 4,081,108

[45] Mar. 28, 1978

[54] TAMPER EVIDENT ONE-PIECE DISPENSING CLOSURES

[75] Inventors: Woodrow S. Wilson, Johnston; Robert E. Hazard, N. Kingstown, both of R.I.

[73] Assignee: Polytop Corporation, Slatersville, R.I.

[21] Appl. No.: 665,728

[22] Filed: Mar. 11, 1976

[51] Int. Cl.[2] ..... B65D 47/08; B65D 47/10

[52] U.S. Cl. ..... 222/153; 222/532; 222/536; 222/541

[58] Field of Search ..... 222/532, 153, 534, 536, 222/541

[56] References Cited

U.S. PATENT DOCUMENTS

| | | | |
|---|---|---|---|
| 3,127,063 | 3/1964 | Fairchild | 222/153 |
| 3,250,436 | 5/1966 | Kurtz | 222/153 |
| 3,255,928 | 6/1966 | Foster | 222/153 |
| 3,303,971 | 2/1967 | Stevens | 222/532 X |
| 3,651,992 | 3/1972 | Hazard | 222/153 |
| 3,655,099 | 4/1972 | Hazard | 222/536 X |

FOREIGN PATENT DOCUMENTS

| | | | |
|---|---|---|---|
| 2,357,611 | 5/1975 | Germany | 222/534 |

*Primary Examiner*—Robert B. Reeves
*Assistant Examiner*—Frederick R. Handren
*Attorney, Agent, or Firm*—Edward D. O'Brian

[57] ABSTRACT

It is possible to provide a dispensing closure which is tamper evident by using a relatively flexible strap connecting the movable end of a spout as conventionally used in such a closure with a cap or cap body employed in such a closure. The use of such a strap makes it possible to mold the spout and the cap as a unitary article. The assembly of a dispensing closure from such an article avoids the possible problem of a "wrong" spout being assembled with a specific cap or cap body. The strap employed should not extend from the cap so as to interfere with the use of conventional capping apparatus. The strap used can be shaped and dimensioned to facilitate location of the spout during the assembly of the spout on the cap or cap body and, if desired, as a cover for the passage in the spout when the spout is assembled in an operative position.

1 Claim, 11 Drawing Figures

TAMPER EVIDENT ONE-PIECE DISPENSING CLOSURES

PERTINENT PRIOR PATENTS

Robert E. Hazard U.S. Pat. No. 3,651,912, issued Mar. 28, 1972, entitled "TAMPER-PROOF CLOSURE"; Woodrow S. Wilson U.S. Pat. No. 3,690,514, issued Sept. 12, 1972, entitled "INITIALLY SEALED CLOSURES WITH SEALING STRUCTURES".

BACKGROUND OF THE INVENTION

The invention set forth in this specification pertains to new and improved dispensing closures. More specifically it pertains to dispensing closures which are tamper evident and/or tamper proof in the sense that they provide a visual indication as to whether or not such closures have previously been opened.

The term "dispensing closures" has commonly been recognized to define closures having a cap and a spout. The cap in such a closure is normally constructed so as to include a cap body, a structure or means for either attaching or securing the cap body to a container and an opening leading through the cap body. The spout in such a closure is normally an elongated member having a passage extending between its ends. In such a closure co-acting members or means are provided for rotatably mounting the spout on the cap body so that the spout is capable of being rotated between an opened position in which the spout extends from the cap body with the passage in alignment with the opening and a closed position in which contact between the spout and the cap body closes off the opening.

Dispensing closures as indicated are commonly formed by separately molding the spout and the cap out of a somewhat flexible, somewhat resilient material such as a conventional polyolefin polymer in such a manner that the spout may be assembled upon the cap by applying pressure to the spout so as to "snap" together the co-acting members on the spout and the cap which rotatably mount the spout in an operative position. For reasons which are unimportant to an understanding of the present invention a dispensing closure manufacturer will frequently manufacture a variety of different spouts and a variety of different caps having identical co-acting parts such as trunions on such spouts and bearing openings on such caps. As a consequence of this there is the danger that due to error spouts will be assembled upon caps which are not intended to be utilized with such caps.

Such assembly of a conventional dispensing closure involves the orientation of a separate spout with respect to the cap body of such a closure in such a manner that the co-acting members used to rotatably mount the spout are aligned with reasonable precision in such a manner that the spout and the cap may be pressed or "snapped" together. Such positioning of spouts relative to caps in the production of dispensing closures can be and has been considered to be a significant problem. To a large extent this problem has been solved through the use of relatively expensive, relatively complex assembly equipment. For economic reasons it is considered that it would be desirable to substitute for such equipment simpler equipment to position a spout relative to a cap so that the cap may be snapped into an operative position.

Another problem in connection with conventional dispensing closures concerns possible ways of constructing such closures so that they are tamper evident or tamper proof. Conventionally such closures are of such a nature that a customer can manipulate them as, for example, when they are installed on a container for a product in a store. Obviously this is undesirable because of the possibility of the container being sold with less than its intended content. While to a degree this possibility can be minimized through the use of a label or the like overlying the spout on a dispensing closure this type of expedient is considered undesirable because of economic considerations and because such a label or the like may have an undesirable aesthetic appearance.

In the past various types of non-dispensing tamper evident or tamper proof closures have been designed and to various extents utilized. An understanding of the invention is not considered to require a detailed review of various structures of this type. In general, however, they have been constructed in such a way as to utilize a strip or band adapted to be broken off of a closure so as to permit the closure to be removed from the container. It is known to utilize such a strip or band in connection with a closure adapted to be permanently mounted on a container and to utilize a sort of "sub-closure" on such a strip or band in connection with an opening in the principal closure. It has also been known to utilize a type of lid mechanism mounted upon a closure adapted to be permanently secured to a container and to couple such a lid mechanism to the base of the closure through the use of extending tabs connected to one another by a small strip or area which is adapted to be severed.

It is not considered that such expedients of the types utilized in the past to provide tamper evident, non-dispensing closures are applicable to dispensing closures. This is because of the inherent character of dispensing closure structures and because of certain manners in which these dispensing closures are used. In connection with the latter, reference is made to conventional, known capping equipment employed in threading certain types of dispensing closures upon container necks. If a dispensing closure is to operate satisfactorily in connection with such equipment the closure should be constructed in such a manner as not to include a projection in such a location as is apt to interfere with the operation of the capping equipment. Further, the closure should be constructed in such a manner that there is no reasonable chance of a part of the closure which is adapted to be severed or torn off being damaged and/or mutilated as such equipment is utilized.

BRIEF SUMMARY OF THE INVENTION

As a consequence of the various considerations and factors noted in this discussion it is believed that there is a need for new and improved dispensing closures. More specifically it is considered that there is a need for dispensing closures which, because of the manner in which they are manufactured, cannot be erroneously assembled. It is also considered that there is a need for dispensing closures which are capable of being automatically assembled in a final configuration utilizing less complex and less expensive equipment than is presently employed for assembling dispensing closures. It is also considered that there is a need for providing dispensing closures which are tamper evident or tamper proof in the sense that they are capable of being visually inspected so as to indicate whether or not they have previously been opened.

Various objectives of the present invention are to provide dispensing closures fulfilling these different needs. The invention is also intended to provide dispensing closures constructed in such a manner to combine all of the features herein indicated to concurrently fulfill all the various needs indicated in the preceding discussion. The invention is also intended to provide new and improved dispensing closures fulfilling one or more of the needs indicated which may be easily and conveniently manufactured and assembled at a comparatively nominal cost, which may be easily and conveniently installed on a container utilizing conventional equipment without significant danger of damage or mutilation, and which are capable of operating reliably as dispensing closures for a prolonged period.

A dispensing closure of the invention has a cap and a spout; the spout having ends and a passage extending through the spout between the ends; the cap including a cap body, means for securing the cap to a container attached to the cap body, and an opening extending through the cap body; the cap body and the spout including co-acting means for rotatably mounting the spout so that the spout can be rotated between an opened position in which the spout extends from the cap body with the passage in alignment with the opening and a closed position in which contact between the spout and the cap body closes off or forms a seal around the opening and in which an end of the spout is located remote from the opening and the means for rotatably mounting the spout.

A dispensing closure of the invention includes the improvement comprising: a flexible strap capable of being severed connecting the cap body to the end of the spout; the cap, the spout and the strap comprising a unitary article of a material capable of being temporarily deformed; the co-acting means on the cap and the spout being capable of being assembled by being pushed together; the strap being sufficiently long so as to permit the spout to be moved from a position in which the spout is spaced from and connected to the cap body to a position in which the co-acting means on the cap body and the spout can be assembled together so as to permit the spout to be assembled on the cap body while the strap connects the spout and the cap body; the strap being sufficiently short so that the spout cannot be moved after the spout is assembled on the cap body to the opened position from the closed position until the strap is severed.

BRIEF DESCRIPTION OF THE DRAWINGS

The invention concerns a number of aspects which are not completely delineated in the preceding summary. These items are best more fully delineated with reference to the accompanying drawings in which.

Figure 1:
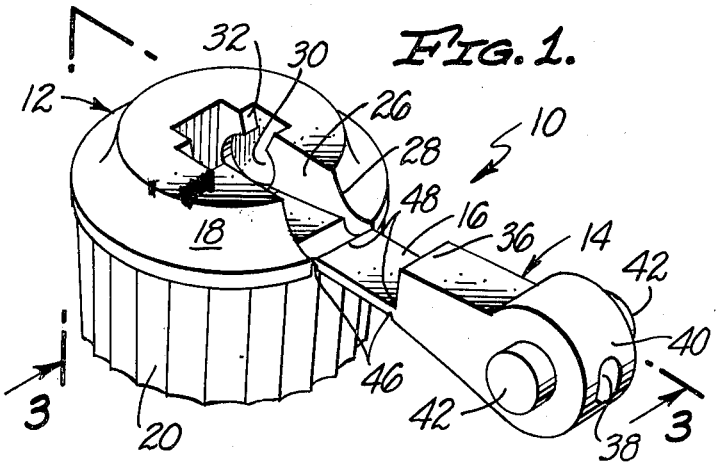
FIG. 1 is an isometric view of a presently preferred embodiment or form of a dispensing closure in accordance with this invention showing the orientation or the parts of this closure after manufacturing these parts as a unitary article and prior to assembly of these parts.
Figure 2:
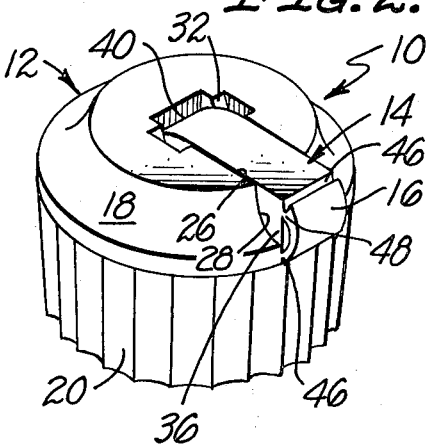
FIG. 2 is an isometric view corresponding to FIG. 1 of the closure shown in FIG. 1 with the various parts of this closure assembled in an operative relationship.
Figure 3:
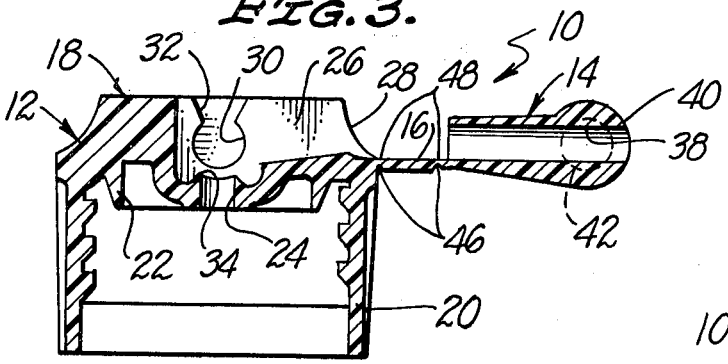
FIG. 3 is a cross-sectional view taken at line 3—3 of FIG. 1.
Figure 4:
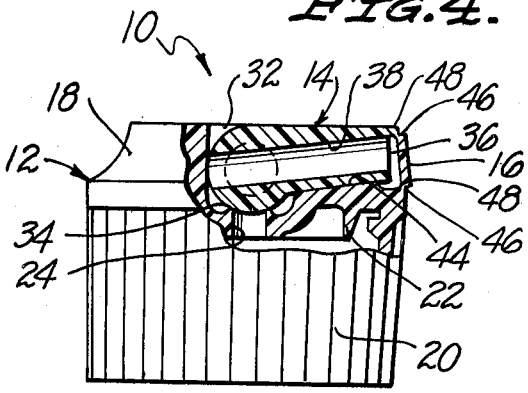
FIG. 4 is a side elevational view of the closure illustrated in the preceding figures assembled as in FIG. 2, part of this view being broken away along a plane corresponding to the plane of the cross-sectional view shown in FIG. 3.
Figure 5:
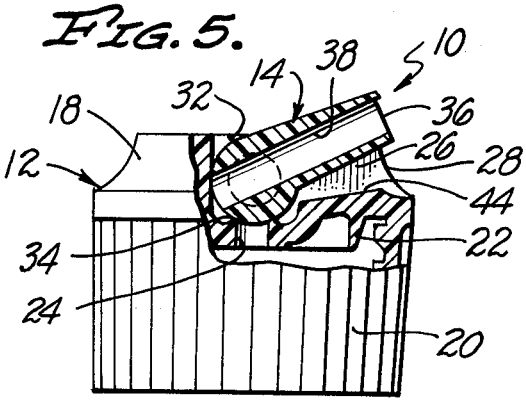
FIG. 5 is a view corresponding to FIG. 4 showing the position of a spout in the closure after a connecting strap has been severed and after the spout has been moved a short distance.
Figure 6:
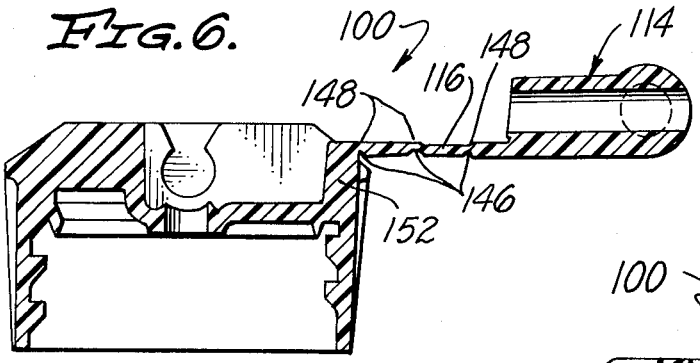
FIG. 6 is a cross-sectional view corresponding to FIG. 3 of a modified dispensing closure of this invention.

It is to be understood that the present invention is not to be considered as being limited to the specific dispensing closures illustrated in the drawings. Various operating concepts and features as are defined in the appended claims are embodied as subsequently indicated in this specification in the illustrated closures. These concepts or features can be embodied within other somewhat differently appearing and/or differently constructed dispensing closures through the use or exercise of routine design or engineering skill in the dispensing closure field.

DETAILED DESCRIPTION

In FIGS. 1 to 5 of the drawing there is shown a dispensing closure 10 in accordance with this invention which is formed as a unitary article or body out of a somewhat flexible, somewhat resilient material such as a conventional polyolefin polymer through the use of known injection molding techniques. As so manufactured prior to assembly this closure 10 appears as indicated in FIG. 1 and contains a cap 12 and a spout 14 connected to the cap 12 by means of a short, rectilinear strap 16. The cap 12 and the spout 14 include various conventional parts as are normally employed in a dispensing closure.

Thus, the cap 12 includes a cap body 18 appearing generally as the top of the cap 12. A dependent internally threaded skirt 20 is integral with this body 18 and is used for the purpose of attaching the cap 12 to an appropriate container (not shown). It is to be understood that various other equivalent or related structures or means (not shown) can be utilized instead of a skirt 20 for the purpose of securing the cap 12 on such a container. In the closure 10 a dependent sealing flange 22 is located concentrically within the skirt 20 for the purpose of forming an effective seal with such a container. A vertically oriented opening 24 leads through the body 18 into an end (not separately numbered) of an elongated slot 26 formed in the body 18. This slot 26 has what may be referred to as an open end 28 remote from the opening 24. Aligned bearing or trunion cavities 30 having restricted entrances 32 are located in the body 18 so as to intersect the slot 26 generally above the opening 24. The body 18 also preferably includes a sealing ring or flange 34 extending around the opening 24 within the slot 26.

The spout 14 is a discharge elongated structure having an end 36 which is adapted to be engaged as the spout 14 is moved between opened and closed positions on the cap 12. This spout 14 has an elongated passage 38 which extends from the end 36 to another end 40 of the spout 14 having the shape of the surface of revolution and, more specifically, a cylindrical shape. Axially aligned trunions or shafts 42 extend from the end 40 in positions in which they are concentric with this end 40.

In the closure 10 the strap 16 is attached to the body 18 so that prior to complete assembly of this closure 10 this strap 16 extends from the body 18 in approximate alignment with the bottom 44 of the slot 26. Preferably this strap 16 includes a groove 46 extending along a line immediately adjacent to the body 18 so that adjacent to this groove 46 the strap 16 consists of a thin line or web 48 of material capable of being severed or broken without significant difficulty. A similar groove 46 is provided in the strap 16 immediately adjacent to the end 36 of the spout 14 so as to also provide a similar web 48 separating the spout 14 from the remainder of the strap 16. It is noted that the end 36 is "squared off" relative to the strap 16. This end 36 is preferably of about the same dimension as the portion of the strap 16 between the web 48 and is dimensioned so that it fits closely against the strap 16 when the closure 10 is assembled.

Such assembly involves folding the strap 16 generally along the web 48 so that the trunions 42 are immediately above the entrances 32. It is considered that the precise formation of the strap 16 as indicated facilitates "folding over" of the spout 14 so as to aid in the proper orientation of the spout 14 so that it can be snapped or popped into its final position. This is considered to make the closure 10 of such a character that it can be easily assembled using less complex equipment than has previously been required.

When the spout 14 is in such a position with the trunions 42 above the entrances 32 pressure or force can be applied so as to "pop" or "snap" the trunions 42 into the cavities 30. As a result of such assembly the spout 14 will be located in an operative position and the strap 16 will be bent so as to assume a position in which it extends across the end 36 of the spout 14 so as to tend to close off the passage 38 from ambient contamination. In this position the strap 16 does not project outwardly from the remainder of the closure 10 to any significant extent. As a consequence of this the closure 10 can be assembled upon a container with conventional capping equipment without difficulty.

When the dispensing closure 10 is to be utilized the strap 16 may be easily severed either manually or through the use of an appropriate cutting or similar tool along the web 48. After this is done the spout 14 may be easily and conveniently rotated between conventional opened and closed positions in an established manner. At this point the presence or absence of the strap 16 may easily be used visually to determine whether or not the closure 10 has been previously used.

In FIGS. 6 and 8 and FIGS. 9 through 11 there are illustrated two other dispensing closures 100 and 200, respectively, constructed in accordance with concepts of the invention. In the interest of brevity those parts of the closures 100 and 200 which are identical or substantially identical to various parts of the closure 10 previously described are not separately identified herein except as may be necessary for identification. Those parts of the closures 100 and 200 which correspond to parts previously described are designated in the drawing and in the remainder of this specification by the numerals previously used to designate these parts preceded by the numerals 1 and 2 in connection with the closures 100 and 200 respectively.

Figure 7:
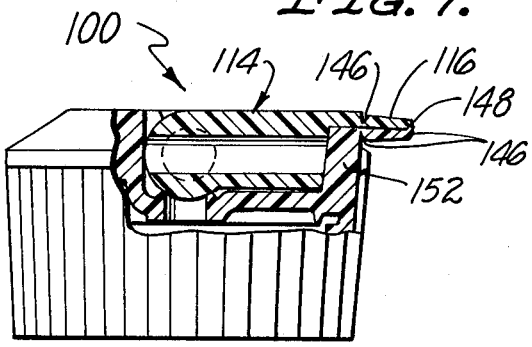
FIG. 7 is a view corresponding to FIG. 4 showing this modified closure.
Figure 8:
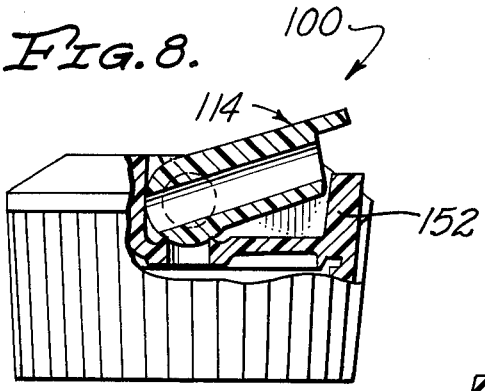
FIG. 8 is a view corresponding to FIG. 5 showing this modified closure.

The closure 100 differs from the closure 10 by having a wall 152 on the closure body 18 instead of having the open end 28 as previously described. In the closure 100 the strap 116 is provided with an additional groove 146 and an additional web 148 midway between grooves 146 and webs 148 at the spout 114 and along the body 118. These grooves 146 and these webs 148 are parallel to one another and are located as shown so as to permit the strap 116 to be folded upon itself as shown in FIG. 7 as the closure 100 is assembled. In this location the folded strap 116 is not believed to extend so far as to preclude the use of the closure 100 with conventional capping apparatus. The strap 116 can, of course, be removed from the closure 10 with a minimum of difficulty prior to the use of this closure 100 and provides a visual indication as to whether or not this closure has been previously opened.

Figure 9:
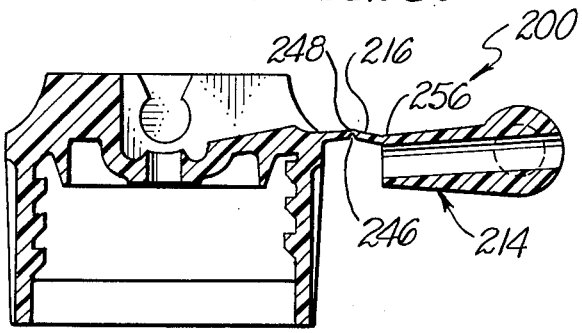
FIG. 9 is a cross-sectional view corresponding to FIG. 3 of a further modified dispensing closure in accordance with the invention.
Figure 10:
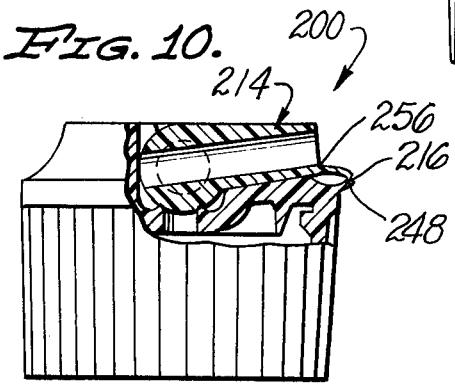
FIG. 10 is a view corresponding to FIG. 2 of this further modified closure.
Figure 11:
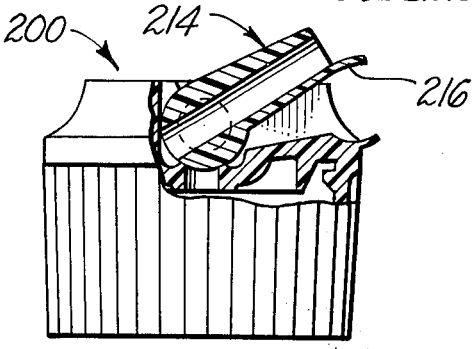
FIG. 11 is a view corresponding to FIG. 5 of this further modified dispensing closure.

The closure 200 differs from the closure 10 primarily in that the strap 216 is shorter than the strap 16 previously described so as to extend between the lower edge 256 of the spout 214 when this spout 214 is assembled in an operative position. Thus the strap 216 does not cover the end 236 of the spout 214 when this spout 214 is in an operative position. Because of the shortened length of the strap 216 it is only considered necessary to provide one groove 246 and one web 248 in the strap 216 to facilitate it being severed. Preferably the spout 214 and the body 218 are dimensioned approximately as indicated in FIGS. 9 to 11 so that the strap 216 does not project so far that it interferes with the operation of and/or becomes damaged during the use of conventional capping equipment. To facilitate this result the spout 214 preferably does not extend to the periphery of the cap 212.

The straps 116 and 216 indicated in connection with the closures 100 and 200 are both of a rectilinear configuration so as to act as the strap 16 in permitting flexure to locate the spouts 114 and 214 in what may be regarded as a "proper" position for the assembly of these closures 100 and 200. These straps 116 and 216 obviously both provide a visual indication as to whether or not these closures have been previously opened. Although it is possible to omit the grooves 46, 146 and 246 and the webs 48, 148 and 248 from the various straps 16, 116, and 216 described this is not preferred since these parts facilitate these straps being severed.

We claim:

1. A dispensing closure having a cap and a spout, said spout having ends and a passage extending through said spout between said ends, said cap including a cap body, means for securing said cap to a container, said means being attached to said cap body and an opening extending through said cap body, said cap and said spout including co-acting means for rotatably mounting said spout for movement between an open position in which said spout extends from said cap body with said passage in alignment with said opening and a closed position in which contact between said spout and said cap body closes off said opening and in which a discharge end of said spout is located remote from said opening and said means for rotatably mounting said spout, in which the improvement comprises:

a flexible, rectilinear strap having parallel linear webs of material located at opposed ends of said strap, one of said webs being connected to an edge of the discharge end of said spout, the other of said webs being connected to said cap body, said cap, said spout and said strap comprising a unitary article of a material capable of being temporarily deformed, said webs being sufficiently thin so as to be capable of being easily severed and being sufficiently flexible so as to be capable of flexing along their lengths during assembly of said closure, said co-acting means on said cap and said spout being capable of being assembled by being pushed together, said strap being sufficiently long so as to permit said spout to be moved from a position in which said spout is spaced from and connected to said cap body to a position in which said co-acting means on said cap and said spout can be assembled together so as to permit said spout to be assembled on said cap body while said strap connects said spout and said cap body, said strap being sufficiently short so that said spout cannot be moved after said spout is assembled on said cap body to said opened position from said closed position until said strap is severed, said strap overlying and covering said discharge end of said spout and said passage when closure is assembled.

* * * * *